US012686044B2

(12) United States Patent
Matsui et al.

(10) Patent No.: US 12,686,044 B2
(45) Date of Patent: Jul. 21, 2026

(54) WIPING APPARATUS AND ROLLING FACILITY

(71) Applicant: PRIMETALS TECHNOLOGIES JAPAN, LTD., Hiroshima (JP)

(72) Inventors: Yoichi Matsui, Hiroshima (JP); Yuta Odawara, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 217 days.

(21) Appl. No.: 18/730,229

(22) PCT Filed: Feb. 14, 2022

(86) PCT No.: PCT/JP2022/005654
§ 371 (c)(1),
(2) Date: Jul. 18, 2024

(87) PCT Pub. No.: WO2023/152964
PCT Pub. Date: Aug. 17, 2023

(65) Prior Publication Data
US 2025/0100036 A1 Mar. 27, 2025

(51) Int. Cl.
*B21B 45/02* (2006.01)

(52) U.S. Cl.
CPC ..... *B21B 45/0278* (2013.01)

(58) Field of Classification Search
CPC . B21B 45/0278; B21B 45/0281; B08B 1/165; B08B 1/20
See application file for complete search history.

(56) References Cited

U.S. PATENT DOCUMENTS 2,929,088 A * 3/1960 Wier, Jr. ..... B08B 1/20 15/181
4,601,112 A * 7/1986 Kush ..... B21B 45/0281 34/95
5,593,506 A * 1/1997 Johnson ..... H10N 60/0184 134/32
6,217,725 B1 4/2001 Van Anglen et al.
6,503,332 B1 * 1/2003 Kawanishi ..... B08B 1/20 15/100

(Continued)

FOREIGN PATENT DOCUMENTS

CN 205496119 U 8/2016
CN 117580654 A * 2/2024 ..... B21B 45/0278

(Continued)

OTHER PUBLICATIONS

Extended European Search Report for European Application No. 22925983.3, dated Feb. 5, 2025.

(Continued)

*Primary Examiner* — Khaled Annis
(74) *Attorney, Agent, or Firm* — Birch, Stewart, Kolasch & Birch, LLP

(57) ABSTRACT

A wiping apparatus for removing a fluid from a surface of a strip of a metal being conveyed, includes a wiping part disposed contactable with a rolled surface of the strip. The wiping part includes a plurality of divided members each of which is disposed contactable with the rolled surface and extends along an extension direction of the wiping part. The plurality of divided members are arranged along the extension direction of the wiping part.

12 Claims, 11 Drawing Sheets

(56) References Cited

U.S. PATENT DOCUMENTS

| | | | | |
|---|---|---|---|---|
| 6,589,357 | B1 * | 7/2003 | Wandres | B08B 7/0092 134/13 |
| 6,662,395 | B1 * | 12/2003 | Hamilton | B08B 1/20 15/3 |
| 9,586,765 | B2 | 3/2017 | Krosschell et al. | |
| 2009/0073222 | A1 * | 3/2009 | Hori | B41J 29/17 347/33 |
| 2012/0282411 | A1 * | 11/2012 | Kurokawa | D01D 5/0084 977/890 |
| 2015/0314349 | A1 * | 11/2015 | Breuer | B21B 1/36 72/201 |
| 2017/0136512 | A1 * | 5/2017 | Serizawa | B21B 45/0218 |
| 2018/0009006 | A1 * | 1/2018 | Eitelhuber | A46B 13/02 |
| 2020/0080168 | A1 * | 3/2020 | Lee | B21B 45/0218 |
| 2021/0039606 | A1 | 2/2021 | LeMonnier et al. | |
| 2023/0142679 | A1 * | 5/2023 | Matsui | G01N 23/16 378/58 |
| 2023/0174318 | A1 | 6/2023 | Kiel et al. | |
| 2023/0398580 | A1 * | 12/2023 | Son | B08B 1/20 |
| 2024/0109340 | A1 * | 4/2024 | Fujishima | B65G 45/22 |
| 2024/0286182 | A1 * | 8/2024 | Matsui | B21B 45/0278 |
| 2025/0010348 | A1 * | 1/2025 | Su | B21B 45/0281 |

FOREIGN PATENT DOCUMENTS

| | | | | |
|---|---|---|---|---|
| CN | 118591425 | A * | 9/2024 | B21B 45/0278 |
| DE | 10 2020 112 875 | B3 | 7/2021 | |
| JP | 52-162235 | U | 12/1977 | |
| JP | 55-77509 | U | 5/1980 | |
| JP | 1-127607 | U | 8/1989 | |
| JP | 2000-210710 | A | 8/2000 | |
| JP | 6870524 | B2 | 5/2021 | |
| KR | 10-1424427 | B1 | 8/2014 | |
| WO | WO-2022034654 | A1 * | 2/2022 | B21B 37/48 |
| WO | WO-2023007541 | A1 * | 2/2023 | B21B 45/0278 |
| WO | WO-2023152964 | A1 * | 8/2023 | B21B 45/0278 |

OTHER PUBLICATIONS

English translation of the International Preliminary Report on Patentability and Written Opinion of the International Searching Authority for International Application No. PCT/JP2022/005654, dated Aug. 29, 2024.

International Search Report, issued in PCT/JP2022/005654, PCT/ISA/210, dated Apr. 5, 2022.

Indian Office Action and Search Report for Indian Application No. 202417052721, dated Mar. 20, 2026, with English translation.

* cited by examiner

WIPING APPARATUS AND ROLLING FACILITY

TECHNICAL FIELD

The present disclosure relates to a wiping apparatus and a rolling facility.

BACKGROUND

In a rolling facility for rolling a strip of a metal, rolling is performed while supplying liquid coolant to a mill roll. If the coolant remains on a surface of the rolled strip, it may become a quality problem. Therefore, a wiping apparatus for removing a liquid, such as coolant, from the surface of the strip has been proposed.

Patent Document 1 describes a wiping apparatus that includes a stationary (contact-type) wiper extending in a direction orthogonal to a conveying direction of a strip of a metal and disposed so as to contact a surface of the strip, downstream of a mill roll for rolling the strip.

CITATION LIST

Patent Literature

Patent Document 1: JP2000-210710A

SUMMARY

Technical Problem

Meanwhile, in a case of, for example, a wiping apparatus that includes a long wiper having single structure (a structure consisting of a single member) as described in Patent Document 1, an entire wiper needs to be replaced even if a partial defect occurs in the wiper. Consequently, a maintenance cost is likely to increase.

In view of the above, an object of at least one embodiment of the present invention is to provide a rolling facility and a wiping apparatus capable of reducing the maintenance cost.

Solution to Problem

A wiping apparatus according to at least one embodiment of the present invention is a wiping apparatus for removing a liquid from a surface of a strip of a metal being conveyed, including: a wiping part disposed contactable with a rolled surface of the strip. The wiping part includes a plurality of divided members each of which is disposed contactable with the rolled surface and extends along an extension direction of the wiping part. The plurality of divided members are arranged along the extension direction of the wiping part.

Further, a rolling facility according to at least one embodiment of the present invention, includes: a mill roll for rolling a strip of a metal; and the above-described wiping apparatus disposed downstream of the mill roll in a conveying direction of the strip.

Advantageous Effects

According to at least one embodiment of the present invention, provided are a rolling facility and a wiping apparatus capable of reducing a maintenance cost.

DETAILED DESCRIPTION

Figure 1:
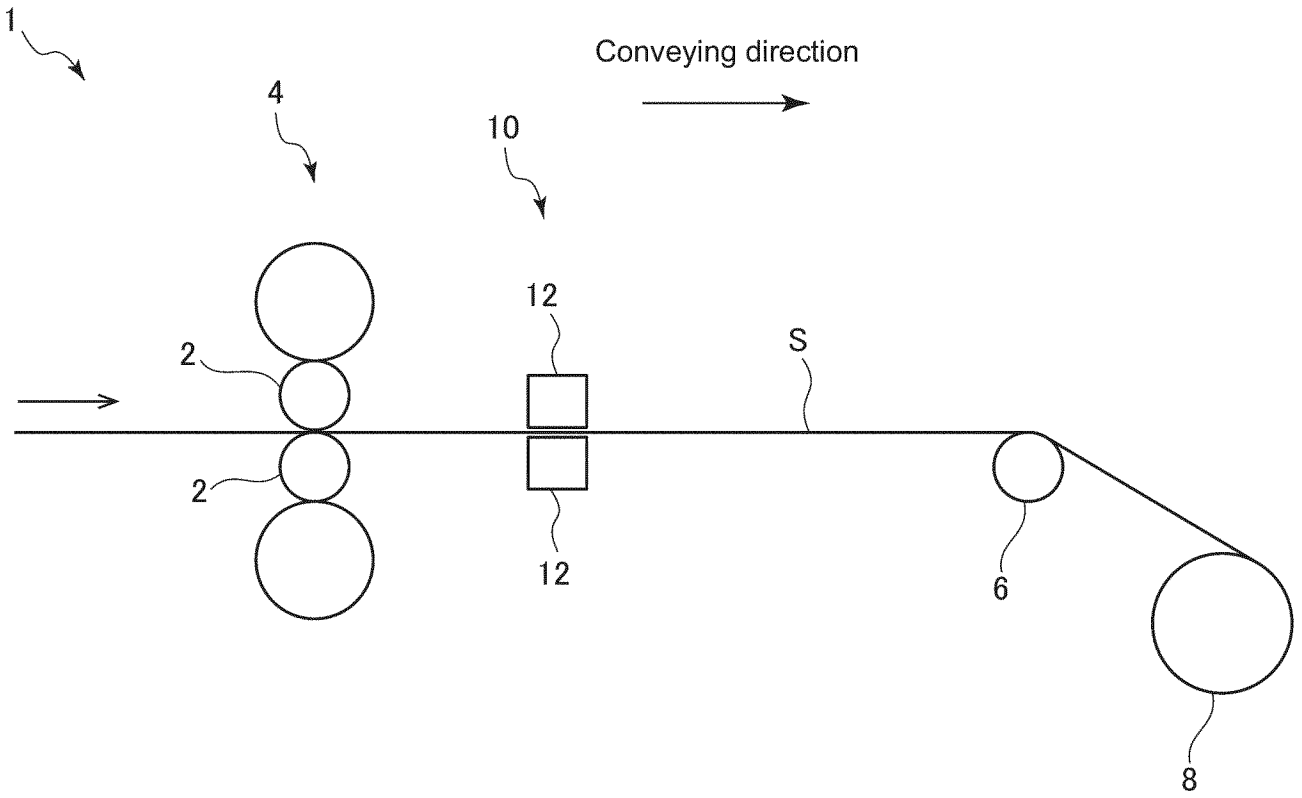
FIG. 1 is a schematic view of a rolling facility according to an embodiment.

Some embodiments of the present invention will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present invention.

FIG. 1 is a schematic view of a rolling facility including a wiping apparatus according to some embodiments. As shown in FIG. 1, a rolling facility 1 according to an embodiment includes a rolling mill 4 including mill rolls 2 for rolling a strip S of metal (steel, etc.), and a wiping apparatus 10 disposed downstream of the mill rolls 2 in a conveying direction of the strip S. As shown in FIG. 1, the rolling facility 1 may include a winding device 8 for winding the strip S rolled by the mill rolls 2, and may include a guide roll 6 disposed between the mill rolls 2 and the winding device 8 and configured to guide the strip S to the mill rolls 2. The wiping apparatus 10 may be disposed between the mill rolls 2 and the winding device 8 in the conveying direction of the strip S.

In the rolling mill 4, rolling is performed while supplying liquid coolant to the mill rolls 2. Thus, the coolant adheres to a surface of the strip S having passed through the mill rolls 2. The wiping apparatus 10 is a wiping apparatus for removing a liquid, such as the coolant, from the surface of the strip S by wiping.

FIGS. 2 and 4 to 8 are each a schematic plan view of the wiping apparatus 10 according to an embodiment. FIGS. 3 and 9 are each a schematic cross-sectional view of the wiping apparatus 10 along the conveying direction of the strip S according to an embodiment.

As shown in FIGS. 1, 3, and 9, the wiping apparatus 10 includes a wiping part 12 disposed contactable with a rolled surface of the strip S. The wiping part 12 is disposed to extend along a direction orthogonal to the conveying direction of the strip S (or a strip width direction of the strip S). The rolled surface of the strip S means, of the surface of the strip S, a surface to be rolled by the mill rolls 2 or a surface rolled by the mill rolls 2 (a surface to be contact with/in contact with outer circumferential surfaces of the mill rolls 2).

As shown in FIG. 2 and FIGS. 4 to 8, the wiping part 12 includes a plurality of divided members 14 arranged along an extension direction of the wiping part 12 (a direction of a straight line L in the figure). Each of the plurality of divided members 14 is disposed contactable with the rolled surface of the strip S and disposed to extend along the extension direction of the wiping part 12 (the direction of the straight line L).

Figure 2:
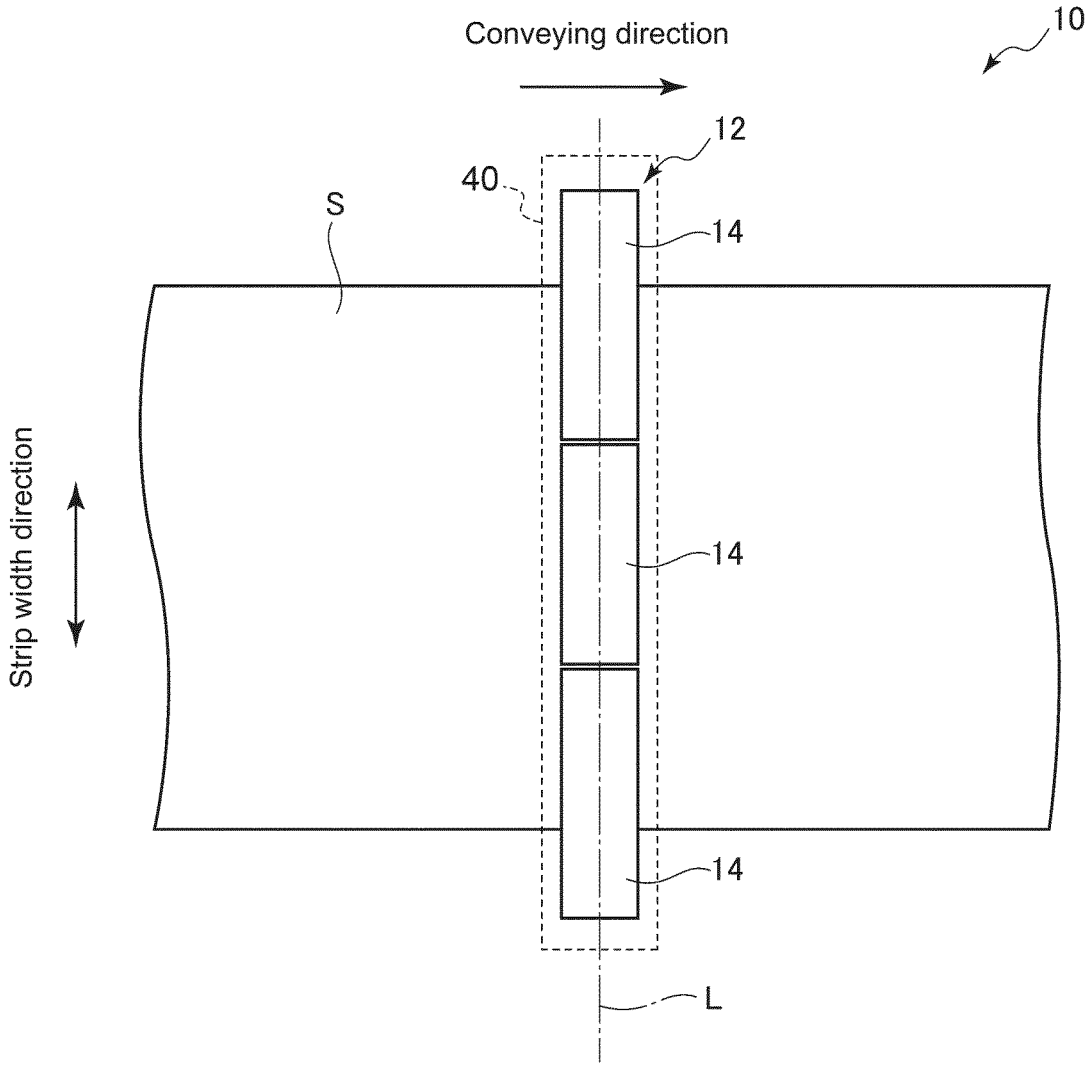
FIG. 2 is a schematic plan view of a wiping apparatus according to an embodiment.
Figure 3:
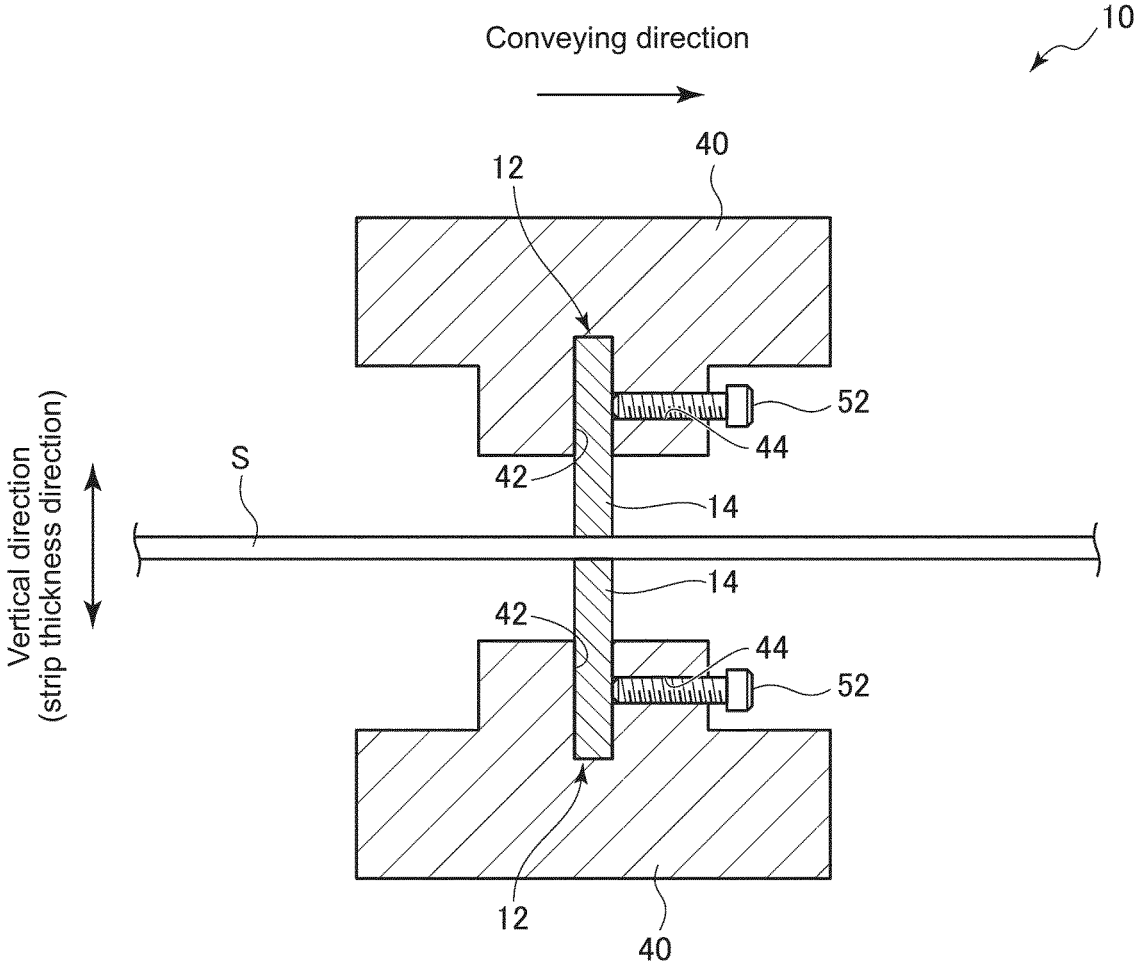
FIG. 3 is a schematic cross-sectional view of the wiping apparatus along a conveying direction of a strip according to an embodiment.
Figure 4:
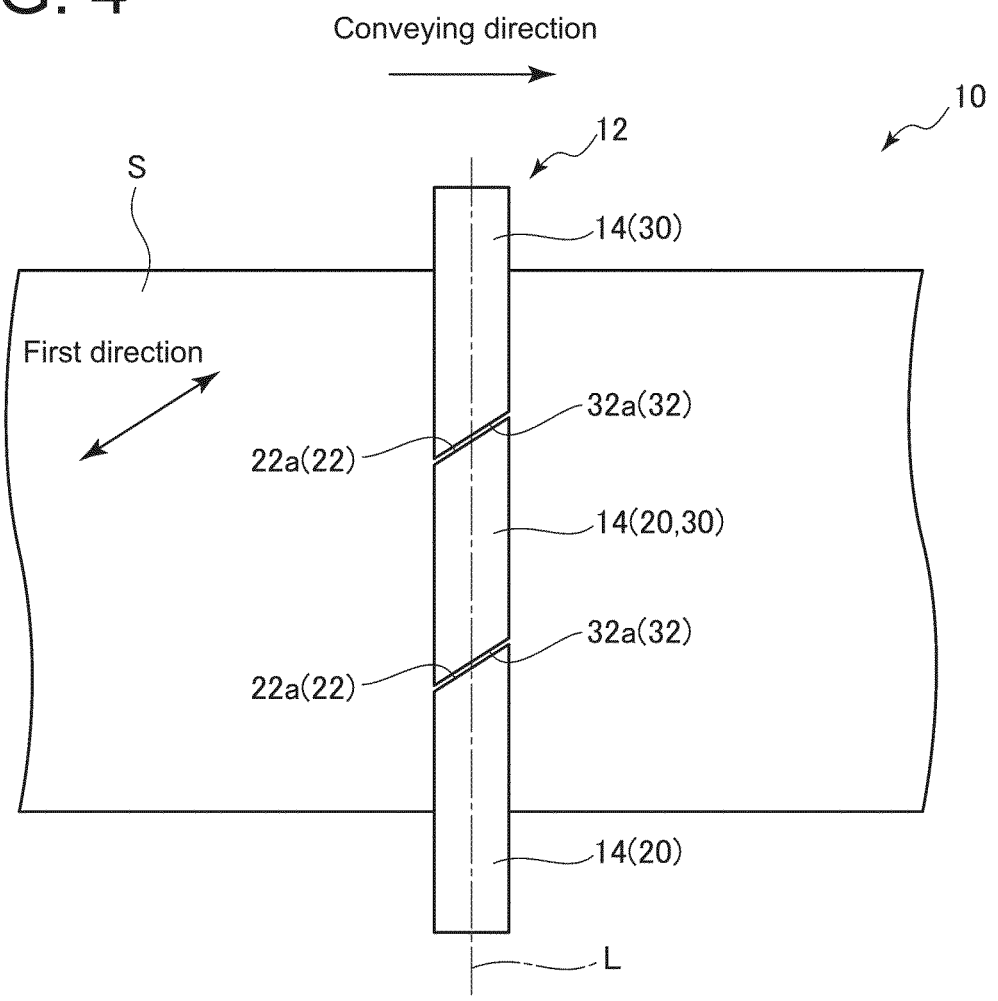
FIG. 4 is a schematic plan view of the wiping apparatus according to an embodiment.
Figure 5:
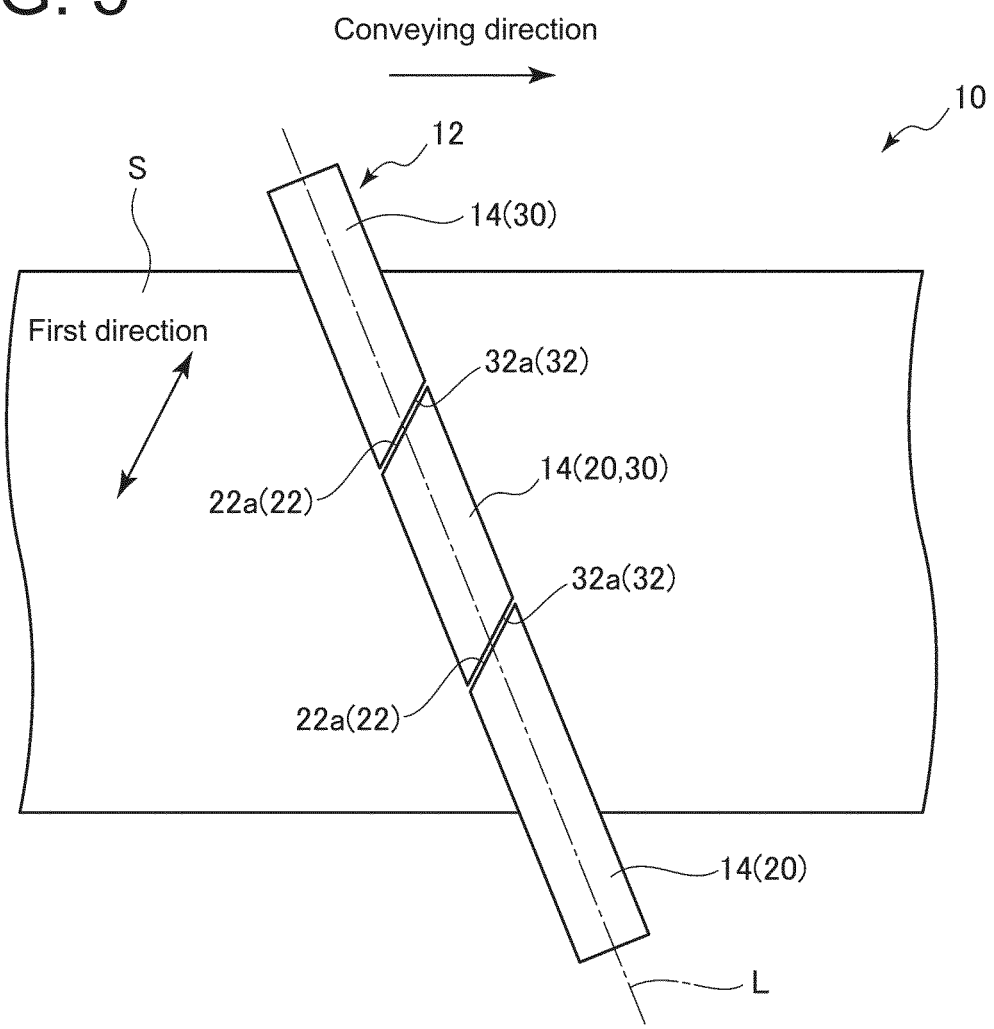
FIG. 5 is a schematic plan view of the wiping apparatus according to an embodiment.

As shown in FIGS. 2, 3, and 9, the plurality of divided members 14 may be held by single holding part 40. The holding part 40 is indicated by a dashed line in FIG. 2, and illustration of the holding part 40 is omitted in FIGS. 4 to 8. In the exemplary embodiments shown in FIGS. 3 and 9, the holding part 40 has a groove 42 extending along the extension direction of the wiping part 12 (a longitudinal direction of the holding part 40) and opening toward the strip S, and part of each of the plurality of divided members 14 is inserted into the groove 42. The holding part 40 is provided with a plurality of screw holes 44 extending in a direction intersecting the extension direction of the wiping part 12 (the longitudinal direction of the holding part 40) and opening to the groove 42. At least one screw hole 44 is disposed in correspondence with each of the plurality of divided members 14. Each of the plurality of divided members 14 is attached to the holding part 40 by being pressed toward an inner wall surface of the groove 42 in the holding part 40 with a plurality of bolts 52 respectively screwed into the plurality of screw holes 44.

As described above, since the wiping part 12 contacting the rolled surface of the strip S during wiping includes the plurality of divided members 14, in case where a defect, etc. occurs in any of the divided members 14, it is possible to partially replace the wiping part 12 (replace only the divided member 14 where the defect, etc. occurs). Therefore, it is possible to reduce a cost associated with maintenance of the wiping apparatus 10.

As shown in FIG. 2 and FIGS. 4 to 8, a pair of divided members 14 adjacent in the extension direction of the wiping part 12 may be disposed such that end surfaces of the divided members 14 in the extension direction face each other. In this case, a size of the wiping part 12 in the conveying direction of the strip S can be reduced compared to a case where one end portion and another end portion of the pair of adjacent divided members 14 are disposed to overlap each other when viewed from the conveying direction of the strip S. Thus, it is possible to obtain the compact wiping apparatus 10.

Alliteratively, although not specifically illustrated, the one end portion and the another end portion of the pair of divided members 14 adjacent in the extension direction of the wiping part 12 may be disposed to overlap each other when viewed from the conveying direction of the strip S. That is, the adjacent divided members 14 may be disposed with a shift in the conveying direction of the strip S.

In some embodiments, for example, as shown in FIGS. 4 to 8, the plurality of divided members 14 include a first member 20 having a first end surface 22 in the extension direction of the wiping part 12 (the direction of the straight line L), and a second member 30 having a second end surface 32 facing the first end surface 22 of the first member 20 and disposed adjacent to the first member 20 in the extension direction of the wiping part 12. The first end surface 22 and the second end surface 32 respectively include first surfaces 22*a*, 32*a* extending along a first direction intersecting the conveying direction of the strip S in plan view. That is, the first surface 22*a* included in the first end surface 22 and the first surface 32*a* included in the second end surface 32 extend along the same direction (first direction) in plan view.

The number of plurality of divided members 14 forming the wiping part 12 is not limited and may be any number at least two. Further, for example, as shown in FIGS. 4 to 8, the plurality of divided members 14 forming the wiping part 12 may include the divided member 14 having both the first end surface 22 and the second end surface 32 (that is, the divided member 14 which is the first member 20 and the second member 30). The first end surface 22 of such divided member 14 faces the second end surface 32 of the another second member 30 (divided member 14) adjacent to such divided member 14 in the extension direction of the wiping part 12, and the second end surface 32 of such divided member 14 faces the first end surface 22 of the another first member 20 (divided member 14) adjacent such divided member 14 in the extension direction of the wiping part 12.

In a configuration where the wiping part 12 includes the plurality of divided members 14, for example, when the facing end surfaces of the pair of adjacent divided members 14 extend along the conveying direction of the strip S, if a gap occurs between the adjacent divided members 14, it is conceivable that coolant leaks downstream in the conveying direction via the gap (remains on the surface of the strip S). If a liquid thus remains on the surface of the strip S, it may become a product quality problem.

In the above-described embodiments, the facing end surfaces (the first end surface 22 and the second end surface 32) of the pair of divided members 14, 14 (the first member 20 and the second member 30) adjacent to each other among the plurality of divided members 14 forming the wiping part 12 have the surfaces (first surfaces 22*a*, 32*a*) extending along the direction (first direction) intersecting the conveying direction of the strip S. Therefore, even if a gap occurs between these end surfaces, an outflow of the liquid (coolant, etc.) to the downstream side in the conveying direction of the strip via the gap is inhibited by the first surfaces 22*a*, 32*a* extending in the direction intersecting the conveying direction of the strip S. Therefore, leakage of the liquid to the downstream side in the conveying direction of the strip via the gap described above is unlikely to occur. Therefore, it is possible to effectively suppress a decrease in product quality of the strip S.

As shown in FIGS. 4 to 8, the first surface 22*a* of the first end surface 22 and the first surface 32*a* of the second end surface 32 may extend along the first direction oblique to the conveying direction of the strip S in plan view.

Further, the first surface 22*a* of the first end surface 22 and the first surface 32*a* of the second end surface 32 may be flat surfaces extending linearly in plan view, or may be curved surfaces curving in plan view, for example, as shown in FIGS. 2 to 8.

Figure 6:
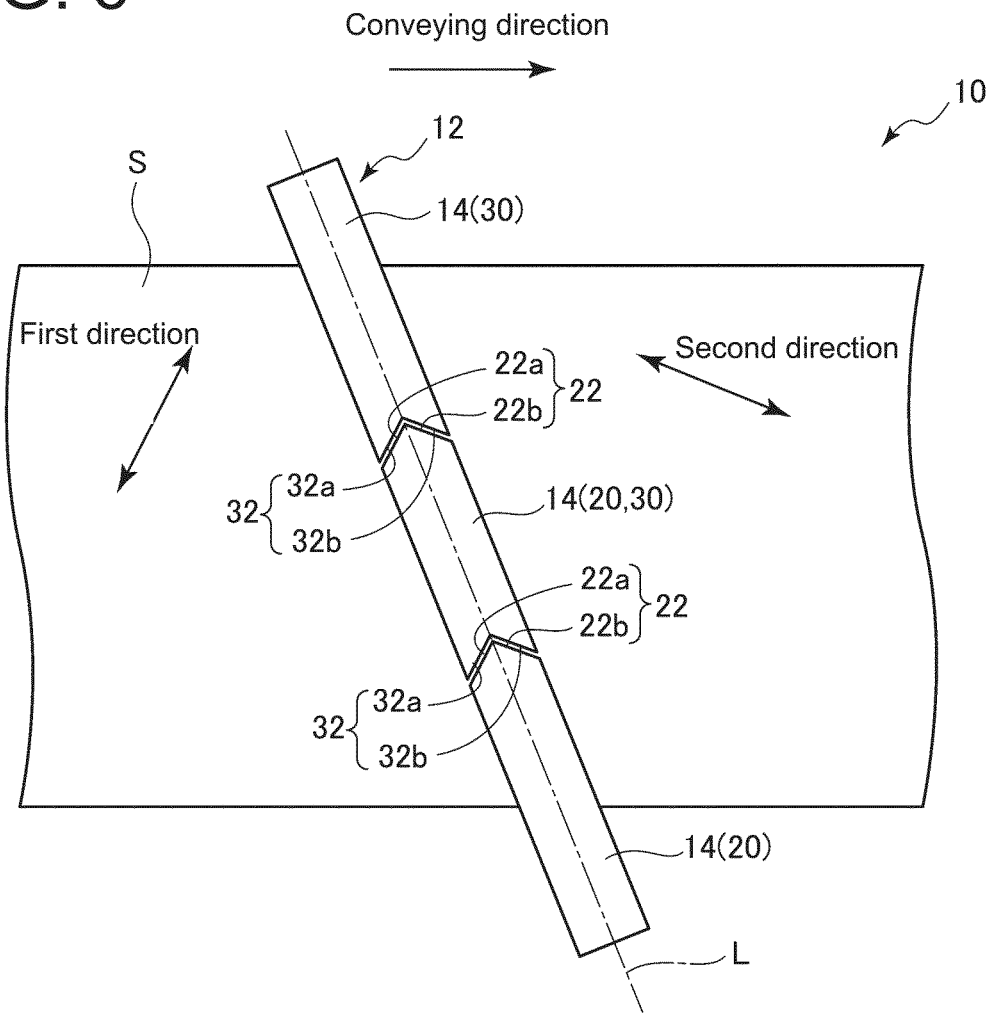
FIG. 6 is a schematic plan view of the wiping apparatus according to an embodiment.
Figure 7:
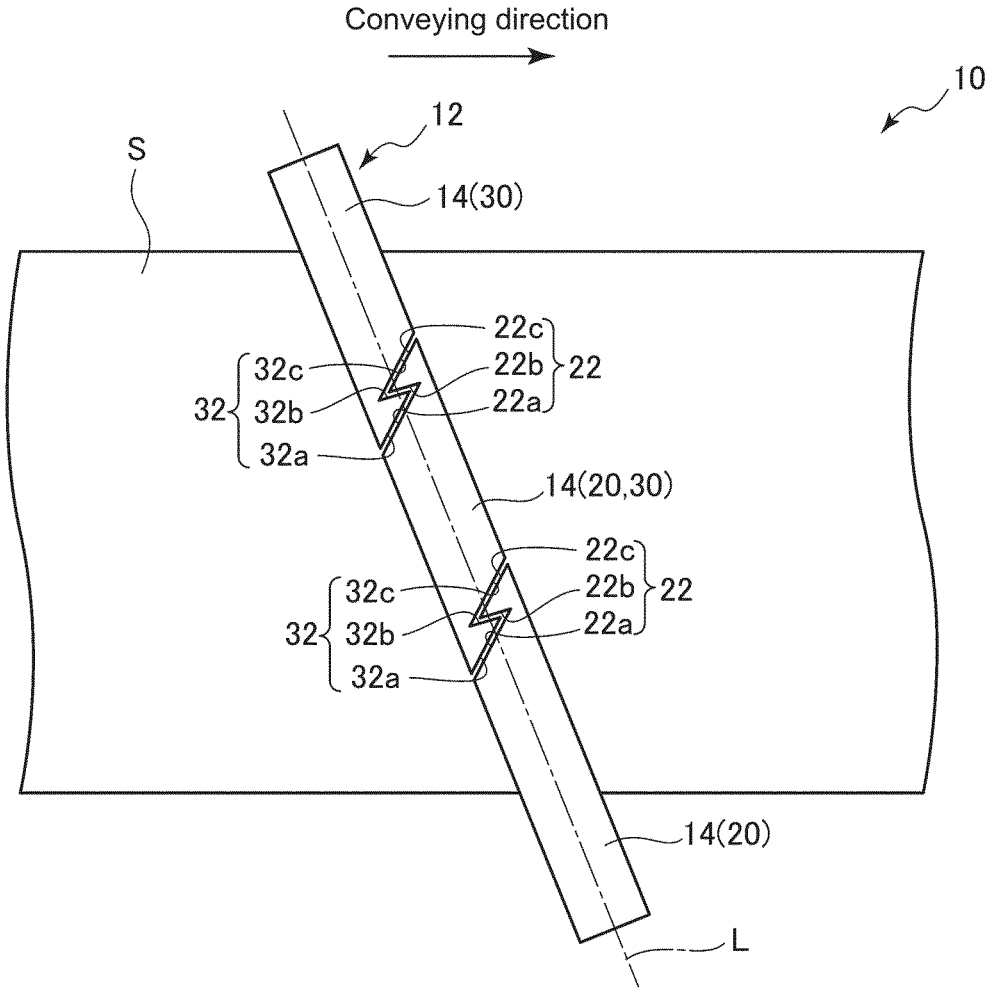
FIG. 7 is a schematic plan view of the wiping apparatus according to an embodiment.

In some embodiments, for example, as shown in FIG. 6 or 7, the first end surface 22 and the second end surface 32 respectively include second surfaces 22*b*, 32*b* extending along a second direction intersecting the above-described first direction (an extension direction of the first surfaces 22*a*, 32*a*) in plan view. That is, the second surface 22*b* included in the first end surface 22 and the second surface 32*b* included in the second end surface 32 extend along the same direction (second direction) in plan view. As shown in FIG. 6 or 7, one end of the first surface 22*a* of the first end surface 22 may be connected to one end of the second surface 22*b*, or one end of the first surface 32*a* of the second end surface 32 may be connected to one end of the second surface 32*b*.

In the exemplary embodiment shown in FIG. 7, the first end surface 22 and the second end surface 32 respectively include third surfaces 22*c*, 32*c* extending along a direction intersecting the above-described second direction (an extension direction of the second surfaces 22*b*, 32*b*) in plan view. That is, the third surface 22*c* included in the first end surface 22 and the third surface 32*c* included in the second end surface 32 extend along the same direction in plan view. As shown in FIG. 7, the one end of the second surface 22*b* of the first end surface 22 may be connected to one end of the third surface 22*c*, or the one end of the second surface 32*b* of the second end surface 32 may be connected to one end of the third surface 32*c*.

According to the above-described embodiment, the facing end surfaces (the first end surface 22 and the second end surface 32) of the pair of divided members 14, 14 (the first member 20 and the second member 30) adjacent to each other among the plurality of divided members 14 forming the wiping part 12 have the above-described first surfaces 22*a*, 32*a* and the second surfaces 22*b*, 32*b* extending along the second direction intersecting the first direction where the first surfaces 22*a*, 32*a* extend. Therefore, even if the liquid enters the gap between the first surfaces 22*a* and 32*a*, the liquid in the gap is difficult to move to the gap between the second surfaces 22*b* and 32*b*. Therefore, even if the gap occurs between the end surfaces (the first end surface 22 and the second end surface 32) of the divided members 14, 14, it is possible to more effectively suppress leakage of the liquid via the gap.

The first surface 22*a* and the second surface 22*b* (and the third surface 22*c*) of the first end surface 22 or the first surfaces 32*a* and the second surface 32*b* (and the third surface 32*c*) of the second end surface 32 may form a zigzag shape in plan view (see FIGS. 6 and 7) or may form a smooth curved surface.

In some embodiments, all of the first end surface 22 of the first member 20 and all of the second end surface 32 of the second member 30 may be contactable. That is, the first end surface 22 of the first member 20 and the second end surface 32 of the second member 30 may have shapes corresponding to each other.

According to the above-described embodiment, the whole of the facing end surfaces (the first end surface 22 and the second end surface 32) of the pair of divided members 14, 14 (the first member 20 and the second member 30) adjacent to each other are contactable. Therefore, even if the gap occurs between the end surfaces (the first end surface 22 and the second end surface 32) of the divided members, it is possible to more effectively suppress leakage of the liquid via the gap.

In some embodiments, for example, as shown in FIG. 9, an elastic member 60 capable of providing the plurality of divided members 14 with a biasing force toward the strip S is disposed between the holding part 40 for holding the plurality of divided members 14 and the at least one of the plurality of divided members 14. In an embodiment, one or a plurality of elastic members 60 capable of providing each of the plurality of divided members 14 with the biasing force toward the strip S is disposed between the holding part 40 and the plurality of divided members 14.

In the exemplary embodiment shown in FIG. 9, the elastic member 60 is disposed inside the groove 42 (a groove where part of the divided member 14 is inserted) of the holding part 40. The elastic member 60 may be disposed between the holding part 40 and the divided member 14 in the vertical direction. The elastic member 60 may include a spring or rubber.

In a rolling facility, etc., a thickness of the strip S is not perfectly constant in the strip width direction, and a certain degree of distribution may occur. In this regard, according to the above-described embodiment, the at least one of the plurality of divided members 14 arranged in the strip width direction is biased toward the strip S by the elastic member 60 disposed between the above-described divided member 14 and the holding part 40. Therefore, even if there is the distribution in the thickness of the strip S in the strip width direction, the divided member 14 adjusts its position in the height direction and is pressed against the surface of the strip S at each position in the strip width direction, by being biased with the elastic member 60. Accordingly, it is possible to effectively suppress uneven wiping in the strip width direction.

In some embodiments, for example, as shown in FIG. 9, the wiping apparatus 10 includes a pressing part 50 for providing the first member 20 (divided member 14) with a pressing force toward the holding part 40 along a direction orthogonal to the extension direction of the wiping part 12 in plan view. As shown in FIG. 9, the pressing part 50 may include the bolt 52 screwed into the screw hole 44 disposed in the holding part 40, and a pushing member 54 disposed in a tip portion of the bolt 52 and configured to push the first member 20 (divided member 14). The bolt 52 may be attached to the pushing member 54 rotatably with respect to the pushing member 54.

Figure 9:
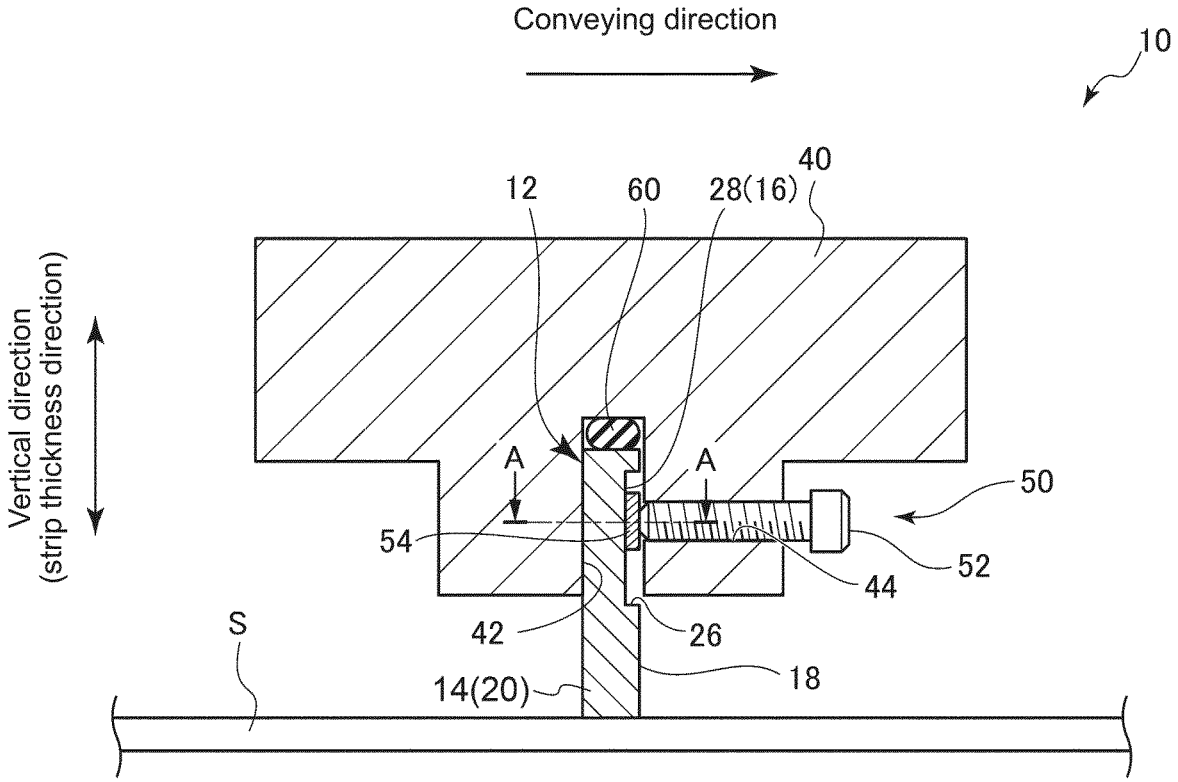
FIG. 9 is a schematic cross-sectional view of the wiping apparatus along the conveying direction of the strip according to an embodiment.
Figure 10:
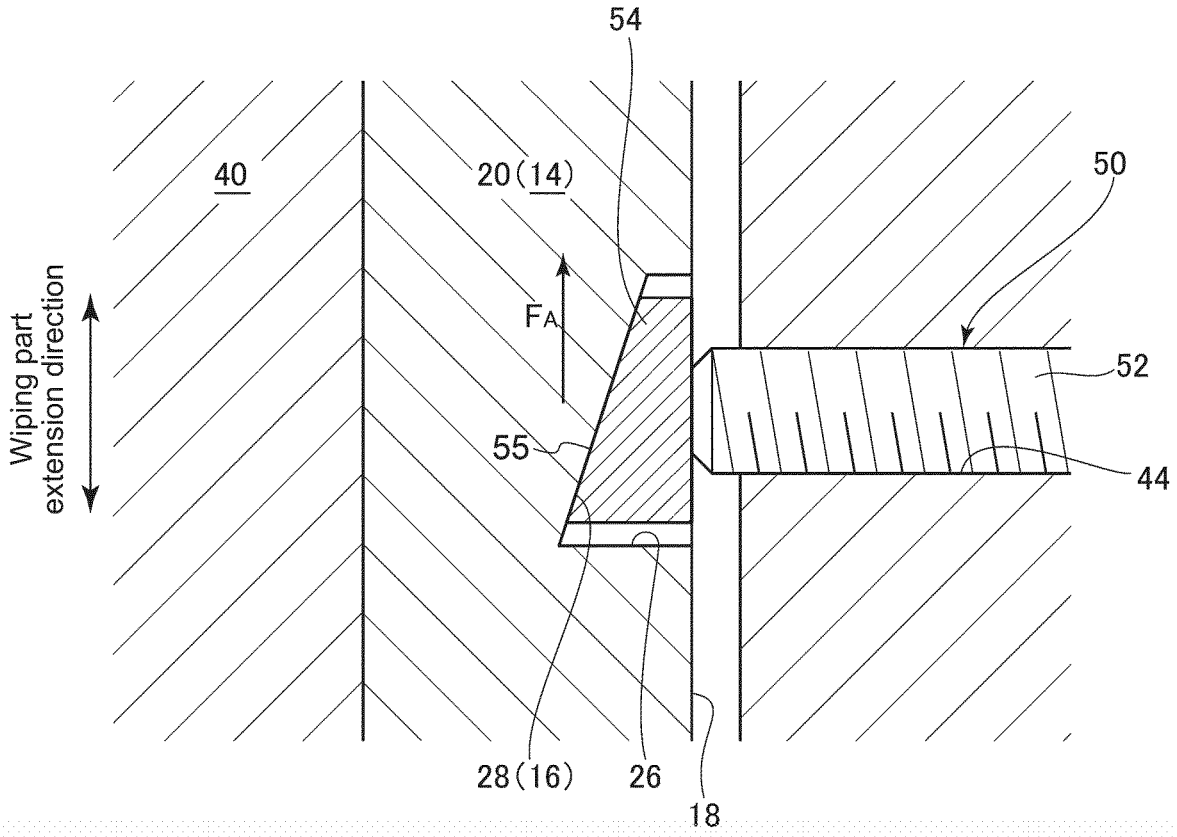
FIG. 10 is a view showing a cross section taken along line A-A in FIG. 9.

FIG. 10 is a view showing a cross section taken along line A-A in FIG. 9. In some embodiments, for example, as shown in FIGS. 9 and 10, the first member 20 (divided member 14) has an inclined surface 16 inclined to the extension direction of the wiping part 12 in plan view, and the pressing part 50 is configured to press the inclined surface 16.

In the exemplary embodiments shown in FIGS. 9 and 10, the pushing member 54 of the pressing part 50 has a surface 55 along the inclined surface 16, and the pressing part 50 is configured to press the first member 20 via the surface 55.

In the exemplary embodiments shown in FIGS. 9 and 10, the first member 20 (divided member 14) includes a lateral surface 18 extending in the extension direction of the wiping part 12 in plan view, and a recess portion 26 disposed to be recessed from the lateral surface 18. Further, a bottom surface 28 of the recess portion 26 includes the above-described inclined surface 16.

Figure 11:
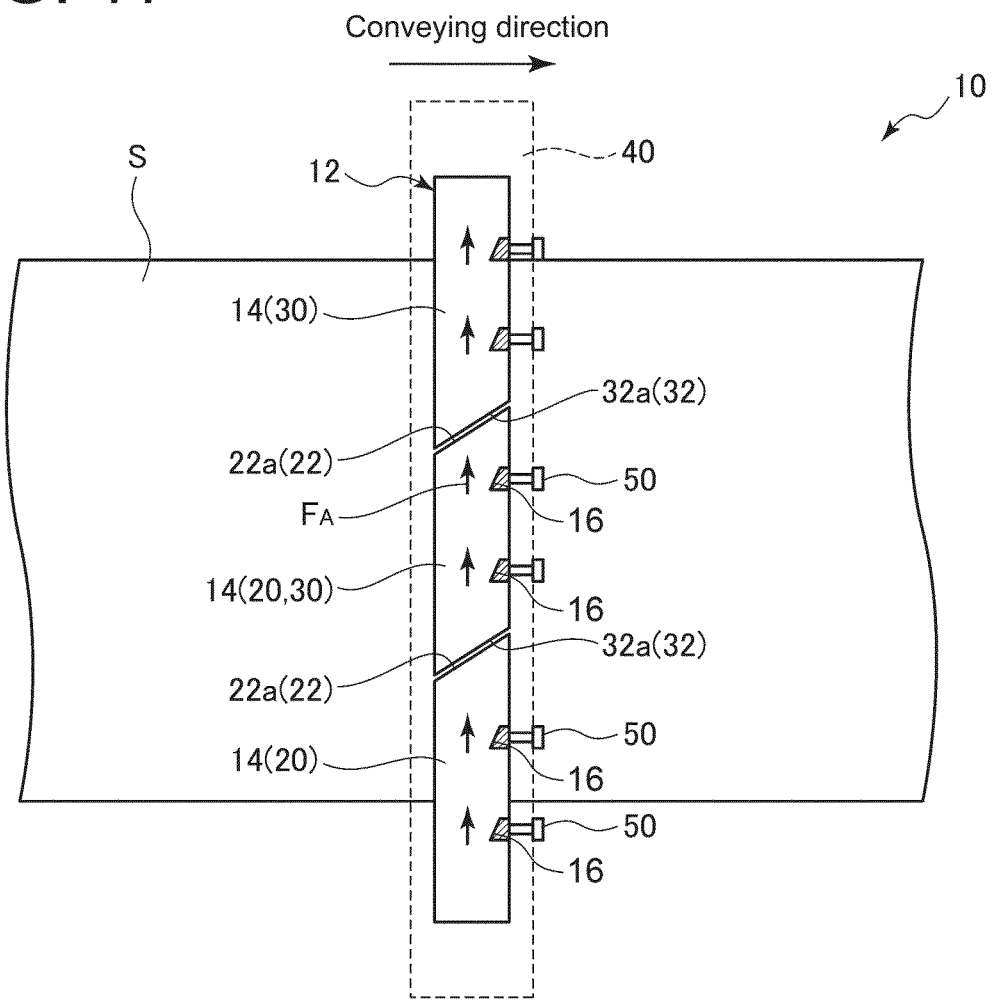
FIG. 11 is a schematic plan view of the wiping apparatus according to an embodiment.

Herein, FIG. 11 is a schematic plan view of the wiping apparatus 10 according to an embodiment, and is a view for describing an action of the wiping apparatus 10 according to an embodiment. In the above-described embodiment, the first member 20 has the inclined surface 16 inclined to the extension direction of the wiping part 12 in plan view, and the inclined surface 16 is pressed by the pressing part 50. The pressing force (pushing force) thus applied to the inclined surface 16 has a component $F_A$ acting so as to press the first member 20 toward the second member 30 (see FIGS. 10 and 11). Thus, since the gap between the end surfaces (the first end surface 22 and the second end surface 32) of the divided member 14 narrows, it is possible to more effectively suppress leakage of the liquid via the gap.

In some embodiments, for example, as shown in FIG. 11, each of the divided members 14 (first members 20) having the first end surface 22 has the inclined surface 16 extending in the same direction, and the pressing part 50 may be configured to provide each of the first members 20 with the pressing force.

According to the above-described embodiment, the inclined surface 16 disposed in each of the divided members 14 (first members 20), among the plurality of divided members 14, having the first end surface 22 (the end surface having the first surface 22*a* extending along the first direction) extends in the same direction oblique to the extension direction of the wiping part 12. Thus, each of the first members 20 is pressed in the same direction toward the adjacent second member 30, with the pushing force applied to each of the inclined surfaces 16 by the pressing part 50. Therefore, each gap between the end surfaces (the first end surface 22 and the second end surface 32) of the divided member 14 tends to narrow, making it possible to more effectively suppress leakage of the liquid via the gap.

In some embodiments, for example, as shown in FIG. 9, the recess portion 26 disposed to be recessed from the lateral surface 18 of the first member 20 (divided member 14) may extend in the vertical direction. Then, the pressing part 50 may be configured to press the bottom surface 28 (inclined surface 16) of the recess portion 26 extending in the vertical direction. Herein, a vertical length of the recess portion 26 is longer than a vertical length of a portion, of the pressing part 50, in contact with the inclined surface 16 (the surface 55 of the pushing member 54 in the illustrated embodiment). Further, a length of the recess portion 26 in the extension direction of the wiping part 12 is slightly longer than a length of the portion, of the pressing part 50, in contact with the inclined surface 16 (the surface 55 of the pushing member 54 in the illustrated embodiment) in the extension direction.

In the above-described embodiment, since the recess portion 26 disposed in the lateral surface 18 of the divided member 14 extends along the vertical direction, the recess portion 26 can guide vertical movement of the pressing part 50 with respect to the divided member 14. Therefore, by providing the above-described elastic member 60 between the holding part 40 and the divided member 14, the divided member 14 can smoothly be moved up and down in accordance with the thickness, etc. of the strip S by the biasing force of the elastic member 60 while the pushing force by the pressing part 50 is applied to the divided member 14.

In some embodiments, for example, as shown in FIGS. 5 to 8, the wiping part 12 extends in the direction oblique to the strip width direction of the strip S. Alternatively, the wiping part 12 extends in a direction oblique to a direction orthogonal to the conveying direction of the strip S.

According to the above-described embodiments, since the wiping part 12 extends in the direction oblique to the strip width direction, a liquid removed from the surface of the strip S by the wiping part 12 and a foreign matter contained in the liquid are less likely to accumulate upstream of the wiping part 12 and more likely to be discharged along the oblique wiping part 12 toward lateral to the strip S. Therefore, it is possible to facilitate discharge of the foreign matter (a solid matter (such as metal powder, etc. generated by wear of the mill roll or the strip, or wear debris, etc. of the wiping part 12) mixed in the coolant) contained in the liquid. Therefore, it is possible to effectively suppress scratch on the surface of the strip S due to the foreign matter accumulating upstream of the wiping part 12.

Figure 8:
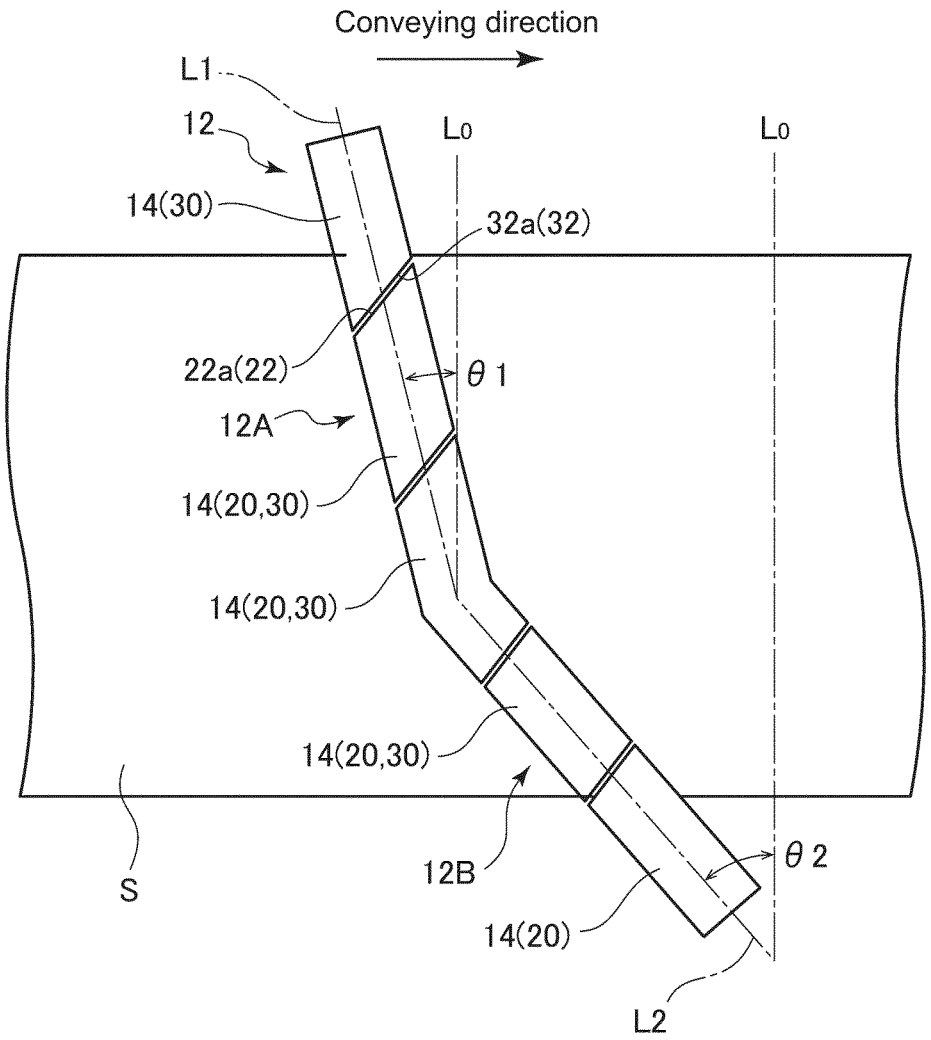
FIG. 8 is a schematic plan view of the wiping apparatus according to an embodiment.

In some embodiments, for example, as shown in FIG. 8, the wiping part 12 includes a first portion 12A, and a second portion 12B adjacent to the first portion 12A and located downstream of the first portion 12A in the conveying direction of the strip S. The first portion 12A and the second portion 12B each extends in the direction oblique to the strip width direction of the strip S. Then, an inclination angle θ2 of the second portion 12B with respect to the strip width direction (or the direction orthogonal to the conveying direction of the strip S) is greater than an inclination angle θ1 of the first portion 12A with respect to the strip width direction (or the direction orthogonal to the conveying direction of the strip S). In FIG. 8, a straight line L0 is a straight line indicating the strip width direction of the strip S (or the direction orthogonal to the conveying direction of the strip S), a straight line L1 is a straight line indicating an extension direction of the first portion 12A, and a straight line L2 is a straight line indicating an extension direction of the second portion 12B.

In the case of the wiping part 12 extending in the direction oblique to the strip width direction, a liquid wiped by the wiping part 12 flows along the wiping part 12 and collects near a downstream portion of the wiping part 12. Consequently, a height of the liquid increases at this position, which may cause the liquid to overflow and flow out to the downstream side of the wiping part 12, for example, when the rolling facility operates at high speed. In this regard, according to the above-described embodiment, since the wiping part 12 includes the first portion 12A oblique to the strip width direction and the second portion 12B whose inclination angle with respect to the strip width direction is greater than the inclination angle of the first portion 12A, a liquid collecting near a downstream end portion of the first portion 12A is likely to smoothly be discharged toward the second portion 12B located further downstream. Thus, it is possible to suppress the overflow and outflow of the liquid to the downstream side in the wiping part 12. Therefore, it is possible to effectively suppress the decrease in product quality of the strip S.

The contents described in the above embodiments would be understood as follows, for instance.

(1) A wiping apparatus (10) according to at least one embodiment of the present invention is a wiping apparatus for removing a liquid from a surface of a strip (S) of a metal being conveyed, including: a wiping part (12) disposed contactable with a rolled surface of the strip. The wiping part includes a plurality of divided members (14) each of which is disposed contactable with the rolled surface and extends along an extension direction of the wiping part. The plurality of divided members are arranged along the extension direction of the wiping part.

According to the above configuration (1), since the wiping part contacting the rolled surface of the strip during wiping includes the plurality of divided members, in case where a defect, etc. occurs in any of the divided members, it is possible to partially replace the wiping part (replace only the divided member where the defect, etc. occurs). Therefore, it is possible to reduce a cost associated with maintenance of the wiping apparatus.

(2) In some embodiments, in the above configuration (1), the plurality of divided members include: a first member (20) having a first end surface (22) in the extension direction; and a second member (30) having a second end surface (32) facing the first end surface of the first member and disposed adjacent to the first member in the extension direction, and each of the first end surface and the second end surface includes a first surface (22*a*, 32*a*) extending along a first direction intersecting a conveying direction of the strip in plan view.

According to the above configuration (2), the facing end surfaces (the first end surface and the second end surface) of the pair of divided members adjacent to each other among the plurality of divided members forming the wiping part have the surfaces (first surfaces) extending along the direction (first direction) intersecting the conveying direction of the strip. Therefore, even if a gap occurs between these end surfaces, leakage of the liquid (coolant, etc.) to the downstream side in the conveying direction of the strip via the gap is unlikely to occur. Therefore, it is possible to effectively suppress a decrease in product quality of the strip.

(3) In some embodiments, in the above configuration (2), each of the first end surface and the second end surface includes a second surface (22*b*, 32*b*) extending along a second direction intersecting the first direction in plan view.

According to the above configuration (3), the facing end surfaces (the first end surface and the second end surface) of the pair of divided members adjacent to each other among the plurality of divided members forming the wiping part have the above-described first surfaces and the second surfaces extending along the second direction intersecting the first direction where the first surfaces extend. Therefore, even if the liquid enters the gap between the first surfaces, the liquid in the gap is difficult to move to the gap between the second surfaces. Therefore, even if the gap occurs between the end surfaces of the divided members, it is possible to more effectively suppress leakage of the liquid via the gap.

(4) In some embodiments, in the above configuration (2) or (3), all of the first end surface and all of the second end surface are contactable.

According to the above configuration (4), the whole of the facing end surfaces (the first end surface and the second end surface) of the pair of divided members adjacent to each other are contactable. Therefore, even if the gap occurs between the end surfaces of the divided members, it is possible to more effectively suppress leakage of the liquid via the gap.

(5) In some embodiments, in any of the above configurations (2) to (4), the wiping apparatus includes: a holding part (40) for holding the plurality of divided members; and a pressing part (50) for providing the first member with a pressing force toward the holding part along a direction orthogonal to the extension direction in plan view. The first member has an inclined surface (16) inclined to the extension direction in plan view. The pressing part is configured to press the inclined surface.

According to the above configuration (5), the first member has the inclined surface inclined to the extension direction of the wiping part in plan view, and this inclined surface is pressed by the pressing part. The pushing force thus applied to the inclined surface has a component acting so as to press the first member toward the second member. Thus, since the gap between the end surfaces (the first end surface and the second end surface) of the divided member narrows, it is possible to more effectively suppress leakage of the liquid via the gap.

(6) In some embodiments, in the above configuration (5), the pressing part includes: a bolt (52) screwed into a screw hole disposed in the holding part; and a pushing member (54) disposed in a tip portion of the bolt and having a surface along the inclined surface.

According to the above configuration (6), the pressing part can be formed with a simple configuration including the bolt screwed into the screw hole disposed in the holding part and the pushing member disposed in the tip portion of the bolt.

(7) In some embodiments, in the above configuration (5) or (6), each of divided members, among the plurality of divided members, having the first end surface has the inclined surface extending in the same direction, and the pressing part is configured to provide each of the first members with the pressing force.

According to the above configuration (7), the inclined surface disposed in each of the divided members (first members), among the plurality of divided members, having the first end surface (the end surface having the first surface extending along the first direction) extends in the same direction oblique to the extension direction of the wiping part. Thus, each of the first members is pressed in the same direction toward the adjacent second member, with the pushing force applied to each of the inclined surfaces by the pressing part. Therefore, each gap between the end surfaces (the first end surface and the second end surface) of the divided member tends to narrow, making it possible to more effectively suppress leakage of the liquid via the gap.

(8) In some embodiments, in any one of the above (1) to (7), the wiping part extends in a direction oblique to a strip width direction of the strip.

According to the above configuration (8), since the wiping part extends in the direction oblique to the strip width direction, the liquid removed from the surface of the strip by the wiping part and the foreign matter contained in the liquid are less likely to accumulate upstream of the wiping part and more likely to be discharged along the oblique wiping part toward lateral to the strip. Therefore, according to the above configuration (8), it is possible to facilitate discharge of the foreign matter (a solid matter (such as metal powder, etc. generated by wear of the mill roll or the strip, or wear debris, etc. of the wiping part) mixed in the coolant) contained in the liquid. Therefore, it is possible to effectively suppress scratch on the surface of the strip due to the foreign matter accumulating upstream of the wiping part.

(9) In some embodiments, in the above configuration (8), the wiping part includes: a first portion (12A); and a second portion (12B) adjacent to the first portion and located downstream of the first portion in a conveying direction of the strip, and an inclination angle (θ2) of the second portion with respect to the strip width direction is greater than an inclination angle (θ1) of the first portion with respect to the strip width direction.

In the case of the wiping part extending in the direction oblique to the strip width direction as in the above (8), a liquid wiped by the wiping part flows along the wiping part and collects near a downstream portion of the wiping part. Consequently, a height of the liquid increases at this position, which may cause the liquid to overflow and flow out to the downstream side of the wiping part, for example, when the rolling facility operates at high speed. In this regard, according to the above configuration (9), since the wiping part includes the first portion oblique to the strip width direction and the second portion whose inclination angle with respect to the strip width direction is greater than the inclination angle of the first portion, a liquid collecting near a downstream end portion of the first portion is likely to smoothly be discharged toward the second portion located further downstream. Thus, it is possible to suppress the overflow and outflow of the liquid to the downstream side in the wiping part. Therefore, it is possible to effectively suppress the decrease in product quality of the strip.

(10) In some embodiments, in any of the above configurations (1) to (9), the wiping apparatus includes: a holding part (40) for holding the plurality of divided members; and an elastic member (60) disposed between the holding part and at least one of the plurality of divided members, and capable of providing the at least one of the plurality of divided members with a biasing force toward the strip.

In a rolling facility, etc., a thickness of the strip is not perfectly constant in the strip width direction, and a certain degree of distribution may occur. According to the above configuration (10), the at least one of the plurality of divided members arranged in the strip width direction is biased toward the strip by the elastic member disposed between the above-described divided member and the holding part. Therefore, even if there is the distribution in the thickness of the strip, the divided member adjusts its position in the height direction and is pressed against the surface of the strip at each position in the strip width direction, by being biased with the elastic member. Accordingly, it is possible to effectively suppress uneven wiping in the strip width direction.

(11) In some embodiments, in the above configuration (10), the wiping apparatus includes: a pressing part for providing the at least one of the plurality of divided members with a pressing force toward the holding part along a direction orthogonal to the extension direction in plan view. The at least one of the plurality of divided members includes: a lateral surface (18) extending along the extension direction in plan view; and a recess portion (26) disposed to be recessed from the lateral surface and extending along a vertical direction. The pressing part is configured to press a bottom surface (28) of the recess portion.

According to the above configuration (11), since the bottom surface of the recess portion disposed in the lateral surface of the divided member has the inclined surface inclined to the extension direction of the wiping part in plan view, and this bottom surface is pressed by the pressing part, the gap between the end surfaces of the divided members narrows, making it possible to effectively suppress leakage of the liquid via the gap. Further, since the recess portion disposed in the lateral surface of the divided member extends along the vertical direction, the recess portion can guide vertical movement of the pressing part with respect to the divided member. Therefore, the divided member can smoothly be moved up and down in accordance with the thickness of the strip while the pushing force by the pressing part is applied to the divided member.

(12) A rolling facility (1) according to at least one embodiment of the present invention, includes: a mill roll (2) for rolling a strip of a metal; and the wiping apparatus (10) according to any one of the above (1) to (11), which is disposed downstream of the mill roll in a conveying direction of the strip.

According to the above configuration (12), since the wiping part contacting the rolled surface of the strip during wiping includes the plurality of divided members, in case where a defect, etc. occurs in any of the divided members, it is possible to partially replace the wiping part (replace only the divided member where the defect, etc. occurs). Therefore, it is possible to reduce a cost associated with maintenance of the wiping apparatus.

Embodiments of the present invention were described in detail above, but the present invention is not limited thereto, and also includes an embodiment obtained by modifying the above-described embodiments and an embodiment obtained by combining these embodiments as appropriate.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "including" or "having" one constitutional element is not an exclusive expression that excludes the presence of other constitutional elements.

REFERENCE SIGNS LIST

1 Rolling facility
2 Mill roll
4 Rolling mill
6 Guide roll
8 Winding device
10 Wiping apparatus
12 Wiping part
12A First portion
12B Second portion
14 Divided member
16 Inclined surface
18 Lateral surface
20 First member
22 First end surface
22*a* First surface
22*b* Second surface
22*c* Third surface
26 Recess portion
28 Bottom surface
30 Second member
32 Second end surface
32*a* First surface
32*b* Second surface
32*c* Third surface
40 Holding part
42 Groove
44 Screw hole
50 Pressing part
52 Bolt
54 Pushing member
55 Surface
60 Elastic member
S Strip

The invention claimed is:

1. A wiping apparatus for removing a liquid from a surface of a strip of a metal being conveyed, comprising:

a wiping part disposed contactable with a rolled surface of the strip, wherein the wiping part includes a plurality of divided members each of which is disposed contactable with the rolled surface and extends along an extension direction of the wiping part, wherein the plurality of divided members are arranged along the extension direction of the wiping part, and wherein the plurality of divided members include:

a first member having a first end surface in the extension direction; and a second member having a second end surface facing the first end surface of the first member and disposed adjacent to the first member in the extension direction.

2. The wiping apparatus according to claim 1, wherein each of the first end surface and the second end surface includes a first surface extending along a first direction intersecting a conveying direction of the strip in plan view.

3. The wiping apparatus according to claim 2, wherein each of the first end surface and the second end surface includes a second surface extending along a second direction intersecting the first direction in plan view.

4. The wiping apparatus according to claim 2, wherein all of the first end surface and all of the second end surface are contactable.

5. The wiping apparatus according to claim 2, comprising:

a holding part for holding the plurality of divided members; and a pressing part for providing the first member with a pressing force toward the holding part along a direction orthogonal to the extension direction in plan view, wherein the first member has an inclined surface inclined to the extension direction in plan view, and wherein the pressing part is configured to press the inclined surface.

6. The wiping apparatus according to claim 5, wherein the pressing part includes:

a bolt screwed into a screw hole disposed in the holding part; and a pushing member disposed in a tip portion of the bolt and having a surface along the inclined surface.

7. The wiping apparatus according to claim 5, wherein each of divided members, among the plurality of divided members, having the first end surface has the inclined surface extending in the same direction, and wherein the pressing part is configured to provide each of the first members with the pressing force.

8. The wiping apparatus according to claim 1, wherein the wiping part extends in a direction oblique to a strip width direction of the strip.

9. The wiping apparatus according to claim 8, wherein the wiping part includes:

a first portion; and a second portion adjacent to the first portion and located downstream of the first portion in a conveying direction of the strip, and wherein an inclination angle of the second portion with respect to the strip width direction is greater than an inclination angle of the first portion with respect to the strip width direction.

10. The wiping apparatus according to claim 1, comprising:

a holding part for holding the plurality of divided members; and an elastic member disposed between the holding part and at least one of the plurality of divided members, and capable of providing the at least one of the plurality of divided members with a biasing force toward the strip.

11. The wiping apparatus according to claim 10, comprising:

a pressing part for providing the at least one of the plurality of divided members with a pressing force toward the holding part along a direction orthogonal to the extension direction in plan view, wherein the at least one of the plurality of divided members includes:

a lateral surface extending along the extension direction in plan view; and a recess portion disposed to be recessed from the lateral surface and extending along a vertical direction, and wherein the pressing part is configured to press a bottom surface of the recess portion.

12. A rolling facility, comprising:

a mill roll for rolling a strip of a metal; and the wiping apparatus according to claim 1, which is disposed downstream of the mill roll in a conveying direction of the strip.

* * * * *